US007118051B1

(12) United States Patent
Jager

(10) Patent No.: US 7,118,051 B1
(45) Date of Patent: Oct. 10, 2006

(54) ROTOR NOZZLE

(76) Inventor: Anton Jager, Hofackergasse 3, D-89250 Senden (DE)

( * ) Notice: Subject to any disclaimer, the term of this patent is extended or adjusted under 35 U.S.C. 154(b) by 0 days.

(21) Appl. No.: 11/201,453

(22) Filed: Aug. 11, 2005

(51) Int. Cl.
*B05B 3/16* (2006.01)
*B05B 3/04* (2006.01)

(52) U.S. Cl. ..... 239/381; 239/240; 239/251; 239/252; 239/256

(58) Field of Classification Search ..... 239/380–383, 239/381, 240, 263, 264, 251, 252, 256
See application file for complete search history.

(56) References Cited

U.S. PATENT DOCUMENTS

| | | | | |
|---|---|---|---|---|
| 2,151,214 | A * | 3/1939 | Kramer | 239/443 |
| 4,747,544 | A | 5/1988 | Kranzle | |
| 4,989,786 | A * | 2/1991 | Kranzle et al. | 239/240 |
| 5,217,166 | A * | 6/1993 | Schulze et al. | 239/227 |
| 5,265,806 | A * | 11/1993 | Ferrarini | 239/251 |
| 5,328,097 | A * | 7/1994 | Wesch et al. | 239/243 |
| 5,332,155 | A * | 7/1994 | Jager | 239/240 |
| 5,395,053 | A * | 3/1995 | Frech | 239/227 |
| 5,551,635 | A * | 9/1996 | Jager | 239/240 |
| 5,598,975 | A * | 2/1997 | Jager | 239/237 |
| 5,722,592 | A * | 3/1998 | Jager | 239/227 |
| 5,941,458 | A * | 8/1999 | Hartmann | 239/381 |
| 6,027,040 | A * | 2/2000 | Frye-Hammelmann | 239/252 |
| 6,029,906 | A * | 2/2000 | Binder et al. | 239/237 |
| 6,129,293 | A * | 10/2000 | Jager | 239/227 |
| 6,196,475 | B1 * | 3/2001 | Jaeger | 239/381 |
| 6,250,566 | B1 * | 6/2001 | Jager | 239/237 |
| 6,360,967 | B1 * | 3/2002 | Schorn | 239/240 |
| 6,676,037 | B1 * | 1/2004 | Marks | 239/237 |
| 6,755,358 | B1 * | 6/2004 | Jaeger | 239/381 |
| 6,766,967 | B1 * | 7/2004 | Harris et al. | 239/251 |

FOREIGN PATENT DOCUMENTS

| | | |
|---|---|---|
| DE | 3532045 | 3/1987 |
| DE | 88 01 793.1 | 2/1988 |
| DE | 3832035 | 12/1989 |
| DE | 3915962 | 9/1990 |
| DE | 4013446 | 5/1991 |
| DE | 4014954 | 5/1991 |
| DE | 91 08 507.1 | 7/1991 |
| DE | 4221587 | 1/1994 |
| DE | 4433646 | 3/1995 |
| DE | 295 12 768 | 8/1995 |
| DE | 297 15 144 | 8/1997 |

* cited by examiner

*Primary Examiner*—David A. Scherbel
*Assistant Examiner*—Seth Barney
(74) *Attorney, Agent, or Firm*—Gifford, Krass, Groh, Sprinkle, Anderson & Citkowski, P.C.

(57) ABSTRACT

A rotor nozzle includes a nozzle housing having an inlet opening at one end and an outlet opening at another end and has a rotor which is arranged in a turbulence chamber and which is provided at its front end facing the outlet opening. A nozzle is supported in a cup bearing and has an inflow opening. A bypass device changes a radial or a tangential component of the liquid flowing into the turbulence chamber, which sets the rotor into rotation. A control surface is provided in the turbulence chamber. A restoring device is provided which is active between the front end of the rotor and the rear rotor end, wherein as the rotor rotary speed increases, the inclination of the rotor increases against the action of a restoration force of the restoring device and the restoring device reduces the rotor inclination as the rotor rotary speed decreases.

1 Claim, 1 Drawing Sheet

ROTOR NOZZLE

FIELD AND BACKGROUND OF THE INVENTION

The invention relates to a rotor nozzle, in particular for high-pressure cleaning devices in accordance with the preamble of claim 1.

Rotor nozzles of this type are generally known and serve to discharge liquid in particular at a high pressure. There is generally a need for rotor nozzles which can be used in as versatile a manner as possible, with the safety of the user moreover in particular being ensured at high operating pressures at any time.

SUMMARY OF THE INVENTION

It is the object of the invention to provide a rotor nozzle of the initially named kind which can be used in as versatile a manner as possible and which is simultaneously as safe as possible.

This object is satisfied by the features of claim 1.

In accordance with the invention, the rotary speed of the rotor, and thus the rotor inclination, can be changed and set to a respectively desired value simply by actuating the bypass device, without an axial movement of the control surface being necessary for this purpose. Depending on the specific design of the rotor nozzle, not only the two extreme positions (minimum rotor inclination and maximum rotor inclination), but also any desired intermediate positions can be selected by the user in this manner in which a stable jet operation is likewise possible, wherein the nozzle discharges a liquid jet cone with an opening angle dependent on the rotary speed and thus on the inclination of the rotor. The minimum rotor inclination can correspond to an angle of inclination of 0° (so-called "zero position"), i.e. the longitudinal axis of the rotor coincides with the longitudinal axis of the turbulence chamber and/or of the nozzle housing. It is consequently possible to work with a more or less fixed point jet or spot jet in this extreme position of the rotor.

The restoring device has the effect, as the rotary speed falls, i.e. as the opening of the bypass device increases, of automatically providing a restoration of the rotor in the direction of a smaller angle of inclination. This restoring effect also occurs in cases of disturbance if e.g. the rotor seizes during rotary operation, i.e. in the inclined state. There is in particular a risk in high-pressure and very high-pressure applications that the user can no longer hold the rotor nozzle in a controlled manner when the liquid is no longer discharged as a conical jet from the seized or "stuttering" rotor set at an angle. The rotor automatically returns into the uncritical zero position or into a position with a low inclination due to the restoring device in accordance with the invention. An additional safety aspect is hereby realized in an advantageous manner by the restoring device. The rotor nozzle can in particular be designed from the start for larger maximum angles of inclination than without the automatic safety restoration in accordance with the invention due to this angular self-restoration in the event of a disturbance.

The rotor nozzle in accordance with the invention is preferably designed such that the nozzle of the rotor can lift off the cup bearing when the rotor is located in its position with a minimum inclination and in particular in the previously mentioned zero position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1A:
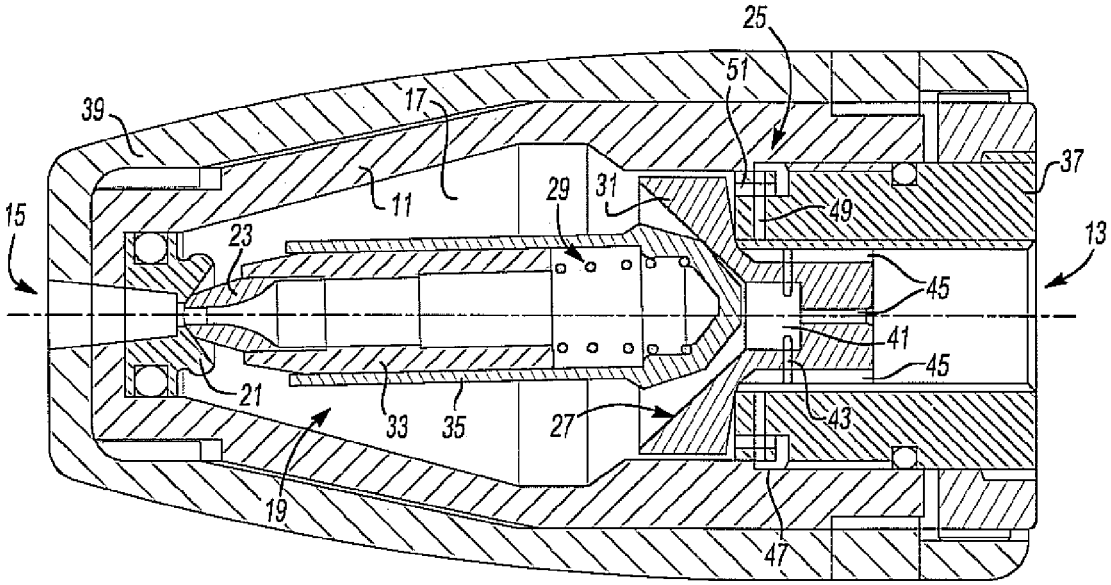
FIG. 1*a* is an embodiment of a rotor nozzle in accordance with the invention with a rotor having a low inclination.

The following description of the preferred embodiment(s) is merely exemplary in nature and is in no way intended to limit the invention, its application, or uses.

In accordance with the invention, a turbulence chamber 17 is provided in a nozzle housing 11 having a rear inlet opening 13 and a front outlet opening 15 and a rotor 19 is arranged in it which comprises a nozzle 23, a rotor body 33 and a rotor sleeve 35 and which is supported at the tip of the nozzle 23 in a cup bearing 21 inserted into the front end of the nozzle housing 11. The sleeve 35 is pushed from the rear over the body 33 into which the nozzle element 23 is in turn inserted. Liquid can flow out of the turbulence chamber 17 into the interior of the cylindrical rotor body 33 and from there outwardly via the nozzle element 23 through one or more inflow openings (not shown) formed at the rear end and/or in the side of the rotor 19.

In the embodiment shown here, the longitudinal axes of the turbulence chamber 17 and of the nozzle housing 11 coincide.

Figure 1B:
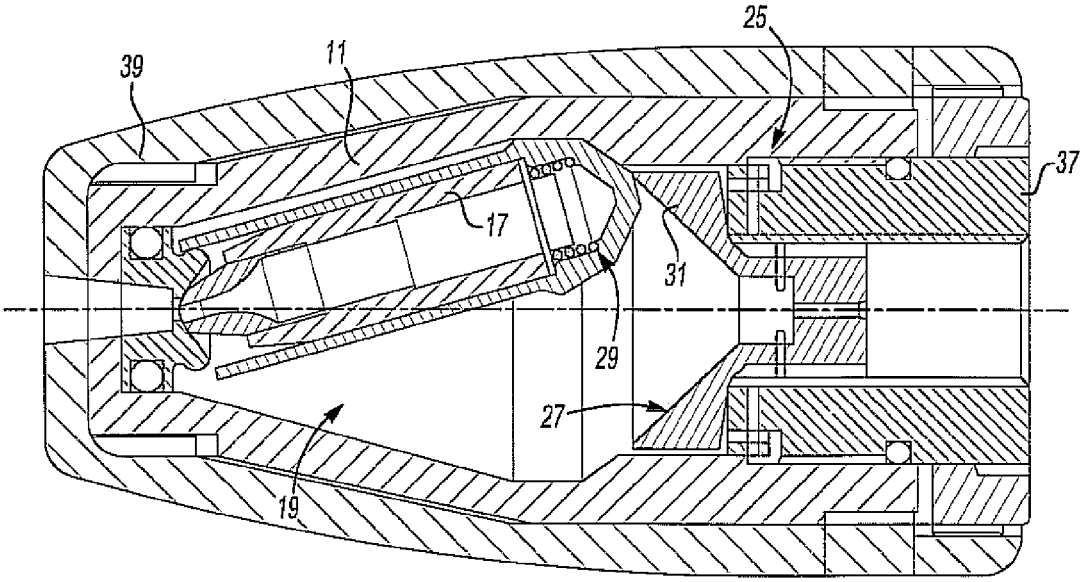
FIG. 1*b* is the rotor nozzle of FIG. 1*a* with a maximally inclined rotor.

The rotor 19 is freely movable to the extent that the rotor inclination can be changed between a minimum angle of inclination of 0° (the longitudinal axes of the rotor 19 and of the turbulence chamber and of the nozzle housing 11 coincide) and a maximum angle of inclination in accordance with FIG. 1*b*.

A restoration spring 29 acts between the rotor sleeve 35 and the rotor body 33 and biases the rear end of the rotor 19 formed by the head of the rotor sleeve 35 to the rear with respect to the rotary body 33 in the direction of a control member 31 whose funnel-shaped control surface 27 faces the interior of the turbulence chamber 17.

The control member 31 is connected to a setting member 37 which is in turn rotationally fixedly connected to an external setting sleeve 39 surrounding the nozzle housing 11. The setting member 37 and thus the control member 31 comprising the control surface 27 is screwed further into or out of the nozzle housing 11—depending on the direction of rotation—by turning the setting sleeve 39 with respect to the nozzle housing 11. In the embodiment shown here, the axial adjustment path is small in comparison with the axial dimensions of the setting member 37 or of the control member 31, i.e. the axial movement of the control member 31, and thus of the control surface 27, is comparatively small on a rotary actuation of the setting sleeve 39.

In an alternative embodiment, the control member 31 can be axially fixedly connected to the nozzle housing 11 so that an actuation of a bypass device 25 described in more detail in the following or one designed differently, e.g. by turning the setting sleeve 39, does not result in any axial movement of the control member 31 and thus of the control surface 27. A separate control member 31 comprising the control surface 27 can in particular be omitted and the control surface cooperating with the rotor 19 can be formed directly at the nozzle housing 11.

In the embodiment shown here, the mentioned bypass device 25 includes switch regions movable relative to one another in the axial direction. The nozzle housing 11 has a switch shoulder at its inside in the region of radial bypass passages 49 of the setting member 37 which are in communication with inflow passages 45. In the functional position in accordance with FIG. 1*a* with a completely open bypass, the bypass passages 49 open into an intermediate space 47 from where the liquid can flow via axial bypass passages 51 past the control member 31 into the turbulence chamber 17. Practically no eddy flows which could set the rotor 19 into rotation arise due to the axial inflow of the liquid. With an open bypass in accordance with FIG. 1*a*, the turbulence effect or rotation effect of the rotor nozzle is consequently minimal.

If the setting member 37 is moved further into the nozzle housing 11 by actuation of the setting sleeve 39, the radial bypass passages 49 are increasingly closed by the corresponding switch surface of the mentioned switch shoulder of the nozzle housing 11. The bypass is completely closed in the functional position in accordance with FIG. 1*b*.

In this extreme position, the liquid flows via the inflow passages 45, via transmission passages 43 formed in the control member 31 and via an antechamber 41 into the turbulence chamber 17, with the transmission passages 43 being made such that the liquid is discharged from the transmission passages 43 in a radial and/or tangential direction, whereby the eddy flow arises in the turbulence chamber 17 which sets the rotor 19 into a rotary movement around the longitudinal axis of the turbulence chamber 17.

A central, axially extending alignment passage 46, via which the inflowing liquid likewise enters the antechamber 41, serves for the alignment of the running behavior of the rotor 19 in the basic design of the rotor nozzle.

The amount of the liquid flowing into the turbulence chamber 17 with a radial or tangential component and setting the rotor into rotation can be continuously changed by means of the bypass device 25.

The rotor 19 is made such that the rear end of the rotor sleeve 35 is spaced apart from the control surface 27 of the control member 31, i.e. the rotor sleeve 35 is not pressed toward the control surface 27 by the restoration spring 29, in the zero position and at small angles of inclination. Abutment means (not shown) can be provided for this purpose which bound the displaceability of the rotor sleeve 35 to the rear on the rotor body 33, i.e. fix a maximum total length of the rotor 19 from the tip of the nozzle 23 up to the rear end formed by the rotor sleeve 35.

The rear end of the rotor sleeve 35 only comes into contact with the control surface 27 from a specific angle of inclination in accordance with FIG. 1*a* in the embodiment shown here. In an alternative embodiment, it is also possible to deviate from a design of the rotor 19 of this type, i.e. it is alternatively possible also to clamp the rotor 19 between the cup bearing 21 and the control surface 27 by means of the restoring device 29 in the zero position and at small angles of inclination.

If, starting from the completely closed bypass device 25 in accordance with FIG. 1*a*, the bypass is increasingly closed by actuation of the setting sleeve 39, the portion of the liquid flowing into the turbulence chamber 17 with a radial or tangential component via the transmission passages 43 of the control member 31 increases so that the rotor 19 hereby set into rotation rotates around the longitudinal axis of the turbulence chamber 17 as the rotary speed increases and discharges the liquid as a conical jet.

As the rotary speed increases, the centrifugal force 19 acting on the rotor 19 increases so that the rotor 19 is driven radially outwardly, i.e. increasingly adopts an angled position, whereby the opening angle of the discharged conical jet becomes larger. The restoration spring 29 is compressed against its restoring force as the inclination of the rotor 19 increases by cooperation of the control surface 27 with the rear end of the rotor 19, i.e. with the rotor sleeve 35. A state of balance is adopted between the turbulence and rotor effect, on the one hand, and the restoring effect, on the other hand, for each position of the bypass device 25.

The user can consequently set the inclination of the rotor 19 continuously via the bypass device 25, with a stable jet operation being possible in each intermediate position between a fully opened bypass and a fully closed bypass with a rotor 19 rotating at a constant inclination.

The maximum rotor inclination 19 is achieved when, in accordance with FIG. 1*b*, a correspondingly formed angled surface of the rotor sleeve 35 contacts a contact surface at the inside of the nozzle housing 11 which extends parallel to the longitudinal axis of the turbulence chamber 17 in this embodiment.

If the bypass is opened again, starting from the closed position (FIG. 1*b*), the restoration spring 29 automatically ensures that the rotor 19 is restored—in dependence on the magnitude of the remaining eddy flow—to a position with a low inclination and, optionally, up to and into the zero position.

It is generally possible by different embodiments of the control surface 27, which can also deviate from the funnel shape shown in accordance with the invention, to set the behavior of the rotor 19 as desired in dependence on an actuation of the bypass device 25.

In accordance with the invention, the bypass device 25 can deviate from the embodiment shown and can generally be designed as desired. Bypass controls are, for example, possible which make use of spherical arrangements and/or disk arrangements for the change of the portion of the eddy flow or rotor flow in the turbulence chamber 17.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A rotor nozzle, in particular for high-pressure cleaning devices, with a nozzle housing having an inlet opening at an axially first end and an outlet opening for liquid at a second end, and with a rotor, which is arranged in a turbulence chamber of the nozzle housing and which the rotor is provided at a front end facing the outlet opening with a nozzle supported in a cup bearing and which the rotor has an inflow opening, comprising:

a bypass device with which the amount of liquid flowing into the turbulence chamber can be changed, wherein the flowing liquid sets the rotor into rotation;

a control surface, which is funnel-like, faces a rear rotor end and is located in the turbulence chamber; and a restoring device, which is active between a front end of the rotor and the rear rotor end and in particular comprises a spring, wherein the control surface and the rear rotor end cooperate during operation, whereby the inclination of the rotor increases against the action of a restoring force of the restoring device as the rotor rotary speed increases, and the restoring device reduces the rotor inclination as the rotor rotary speed decreases.

* * * * *